US011493306B2

(12) United States Patent
Patrick, IV

(10) Patent No.: US 11,493,306 B2
(45) Date of Patent: Nov. 8, 2022

(54) FIREARM ILLUMINATOR

(71) Applicant: James Robert Patrick, IV, Springfield, VA (US)

(72) Inventor: James Robert Patrick, IV, Springfield, VA (US)

(73) Assignee: PATRICKORD LLC, Charles Town, WV (US)

( * ) Notice: Subject to any disclaimer, the term of this patent is extended or adjusted under 35 U.S.C. 154(b) by 0 days.

(21) Appl. No.: 17/209,649

(22) Filed: Mar. 23, 2021

(65) Prior Publication Data

US 2021/0389083 A1 Dec. 16, 2021

Related U.S. Application Data

(60) Provisional application No. 63/008,397, filed on Apr. 10, 2020.

(51) Int. Cl.

| | |
|---|---|
| ***F41G 1/35*** | (2006.01) |
| ***F41G 1/033*** | (2006.01) |
| *F41G 11/00* | (2006.01) |

(52) U.S. Cl.

CPC ..... *F41G 1/35* (2013.01); *F41G 1/033* (2013.01); *F41G 11/003* (2013.01)

(58) Field of Classification Search

CPC ..... F41G 1/35
USPC ..... 42/146, 114
See application file for complete search history.

(56) References Cited

U.S. PATENT DOCUMENTS

2014/0109457 A1* 4/2014 Speroni ..... F41G 1/35 42/114

OTHER PUBLICATIONS

Matt, "Review: ROSCH Works SL1 Sight Light," Jerking The Trigger, https://jerkingthetrigger.com/2013/11/04/review-rosch-works-sl1-sight-light/, Nov. 4, 2013, Accessed Feb. 25, 2021.

Midwest Public Safety Outfitters LLC, "VISM by NcStar AR15 FlashLight w/A2 Iron Front Sight," Midwest Public Safety Outfitters LLC, https://www.mps-outfitters.com/shop/vism-by-ncstar-ar15-flashlight-w-a2-iron-front-sight/, (c) 2020, Accessed Feb. 25, 2021.

* cited by examiner

*Primary Examiner* — Reginald S Tillman, Jr.
(74) *Attorney, Agent, or Firm* — Bennet K. Langlotz; Langlotz Patent & Trademark Works, LLC

(57) ABSTRACT

A firearm illuminator has a housing having a front portion, a rear portion, and an intermediate portion between the front and rear positions, a light source at the front portion, a power source at the rear portion, a power conductor interconnecting the light source and the power source and coextensive with the intermediate portion, and a weapon sight connected at the intermediate portion between the light source and the power source. the weapon sight may be a post sight. The weapon sight may be a front sight configured to register with a rear weapon sight. The weapon sight may be movable between a stowed position and an extended position. An indicating portion of the weapon sight extends above the housing when in the extended position. The housing may have an upper surface below a selected limit level. The weapon sight may be configured to extend above the limit level.

17 Claims, 5 Drawing Sheets

FIREARM ILLUMINATOR

CROSS-REFERENCE TO RELATED APPLICATION

This application claims the benefit of U.S. Provisional Patent Application No. 63/008,397 filed on Apr. 10, 2020, entitled "FIREARM ILLUMINATOR," which is hereby incorporated by reference in its entirety for all that is taught and disclosed therein.

FIELD OF THE INVENTION

The present invention relates to firearms and more particularly to a firearm illuminator.

BACKGROUND OF THE INVENTION

Many modern firearms utilize a standard accessory rail on the top of the firearm upon which the user can attach third-party accessories. Typical accessories include an optical sight, a set of backup iron sights, and a flashlight. For a user to mount all of these accessories to the same rail, either the flashlight or the backup iron sights need to be offset from the centerline "12 o-clock" position. The consequence is that one or more accessories will protrude from the side of the firearm, making the firearm effectively wider and more vulnerable to snagging on objects in the environment. In addition, accuracy could be adversely affected if the backup iron sights are offset from the centerline "12 o-clock" position since the user must fire the firearm at an atypical angle to aim using the backup iron sights.

Prior art flashlights that incorporate an iron front sight post are known. While these solve the problem associated with either the flashlight or the backup iron sights needing to be offset from the centerline "12 o-clock" position, they have several disadvantages. First, the sight post cannot be stowed out of the way when not in use, which increases the risk of the firearm snagging on objects in the environment and also causes the sight post to obscure the sight picture through an optical sight mounted on the same accessory rail as the flashlight. Second, they locate the sight post rearward of where an integrated sight post would be, which reduces the maximum sight radius. Third, they utilize a rearwardly mounted switch for controlling the light, which is awkward to use when the firearm is held in the shooting position. Fourth, either the sight post is not adjustable, or the sight post requires a special tool to adjust.

Therefore, a need exists for a new and improved firearm illuminator with an iron sight that folds down when not in use, locates the iron sight as far forward as possible, and has ambidextrous side-mounted switches for controlling the light. In this regard, the various embodiments of the present invention substantially fulfill at least some of these needs. In this respect, the firearm illuminator according to the present invention substantially departs from the conventional concepts and designs of the prior art, and in doing so provides an apparatus primarily developed for the purpose of providing a firearm illuminator with an iron sight that folds down when not in use, locates the iron sight as far forward as possible, and has ambidextrous side-mounted switches for controlling the light.

SUMMARY OF THE INVENTION

The present invention provides an improved firearm illuminator, and overcomes the above-mentioned disadvantages and drawbacks of the prior art. As such, the general purpose of the present invention, which will be described subsequently in greater detail, is to provide an improved firearm illuminator that has all the advantages of the prior art mentioned above.

To attain this, the preferred embodiment of the present invention essentially comprises a housing having a front portion, a rear portion, and an intermediate portion between the front and rear positions, a light source at the front portion, a power source at the rear portion, a power conductor interconnecting the light source and the power source and coextensive with the intermediate portion, and a weapon sight connected at the intermediate portion between the light source and the power source. the weapon sight may be a post sight. The weapon sight may be a front sight configured to register with a rear weapon sight. The weapon sight may be movable between a stowed position and an extended position. An indicating portion of the weapon sight extends above the housing when in the extended position. The housing may have an upper surface below a selected limit level. The weapon sight may be configured to extend above the limit level. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
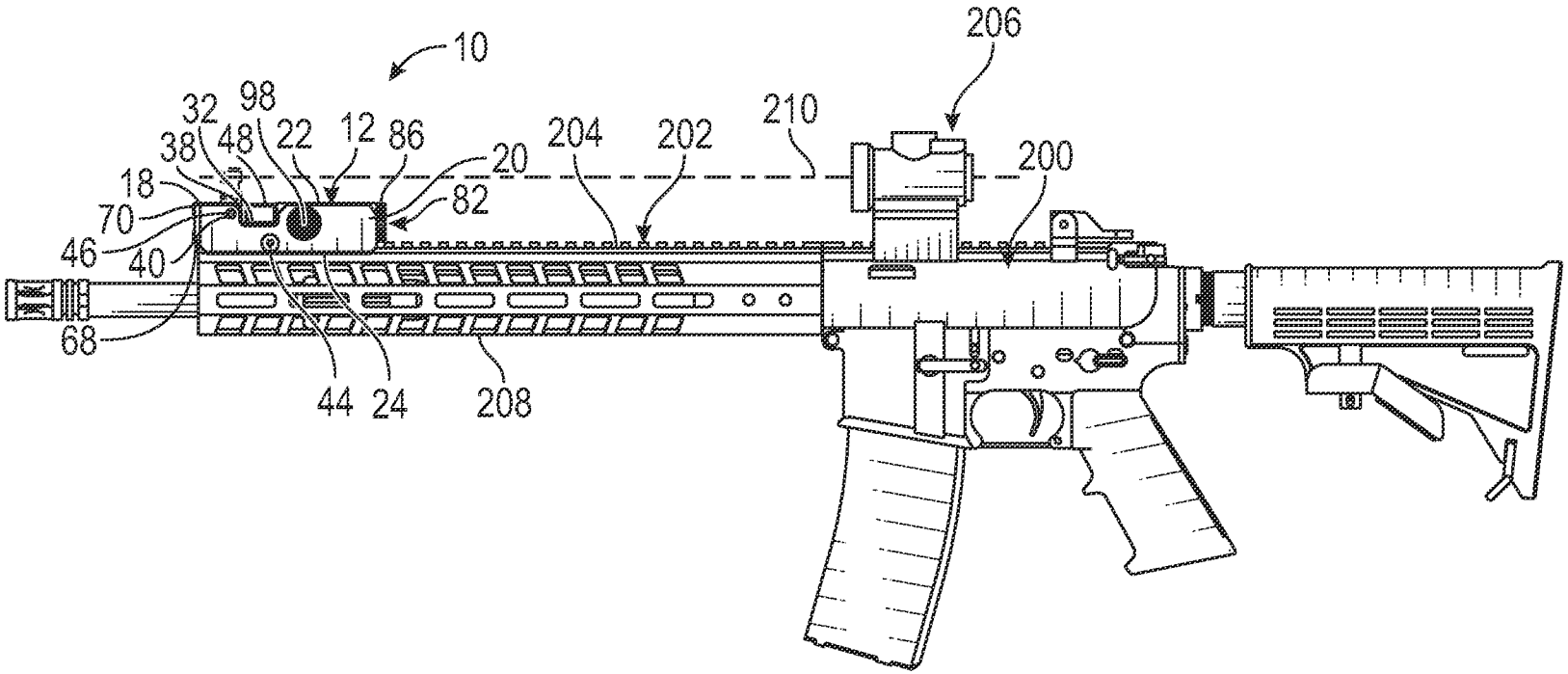
FIG. 1 is a left side view of the current embodiment of the firearm illuminator constructed in accordance with the principles of the present invention installed on a rifle with dashed lines denoting the iron sight in the raised position.
Figure 2:
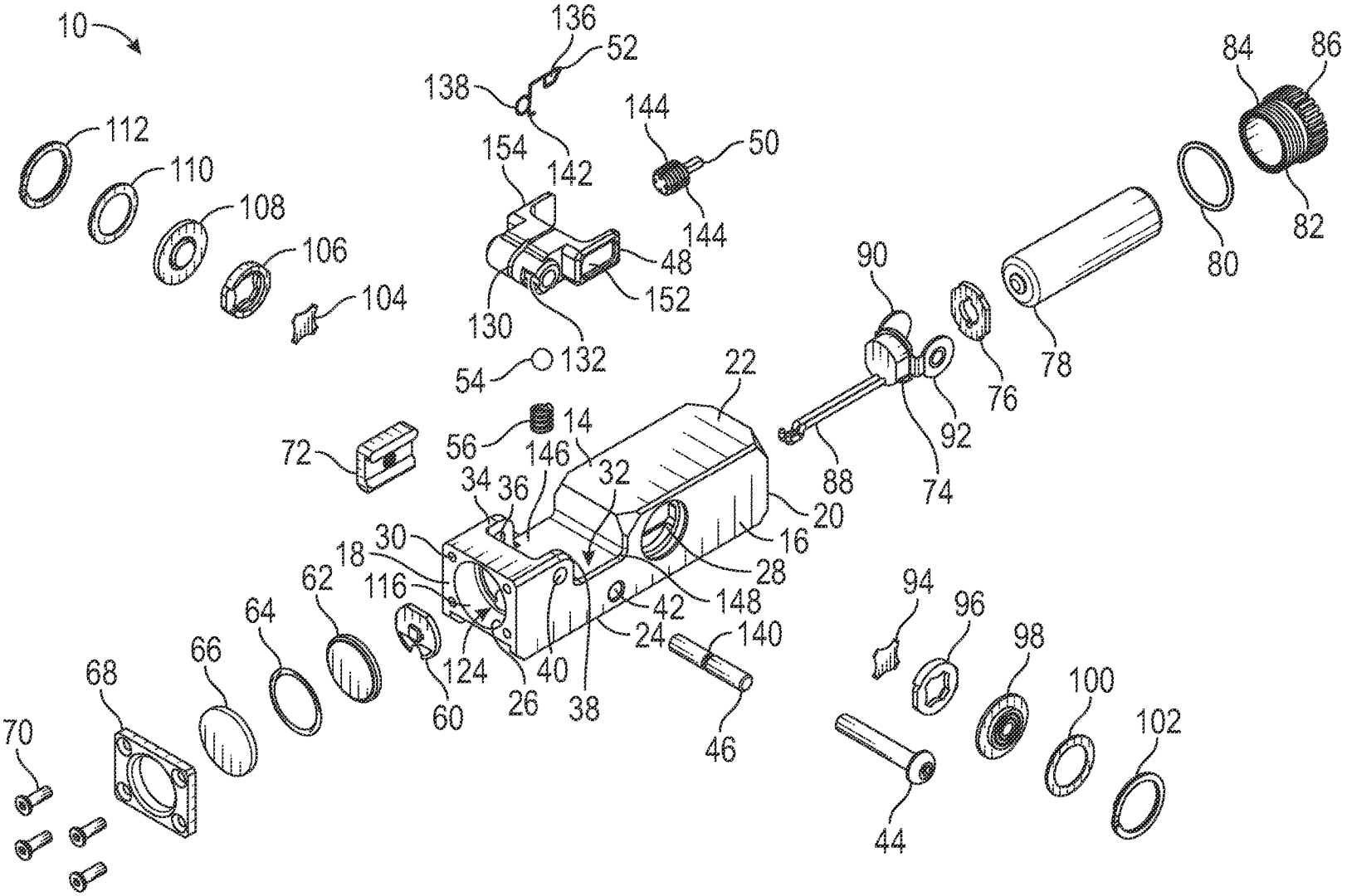
FIG. 2 is an exploded view of the current embodiment of the firearm illuminator of FIG. 1.
Figure 3:
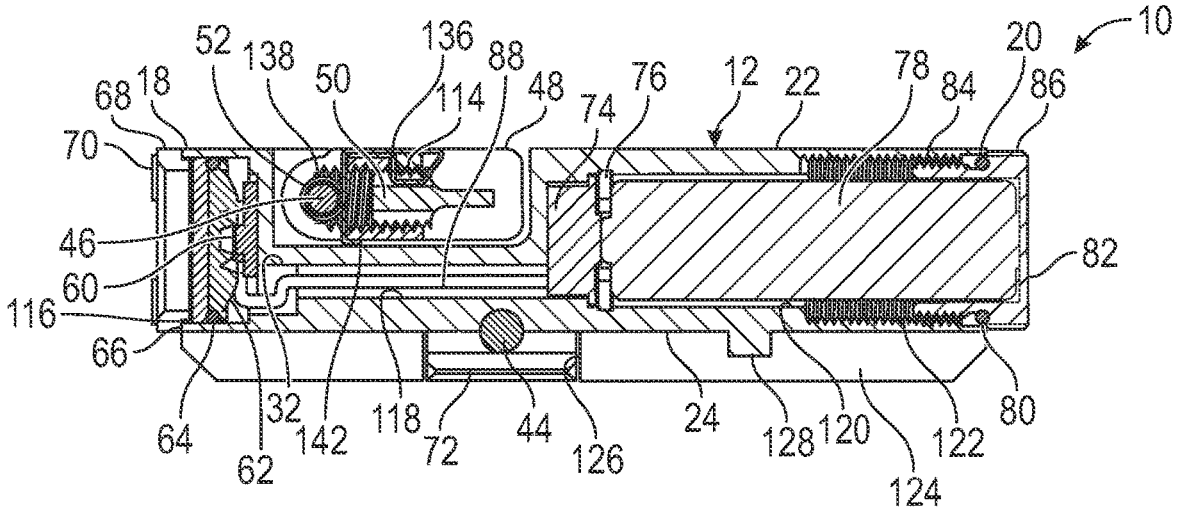
FIG. 3 is a side sectional view of the current embodiment of the firearm illuminator of FIG. 1 taken through the sight post.
Figure 4:
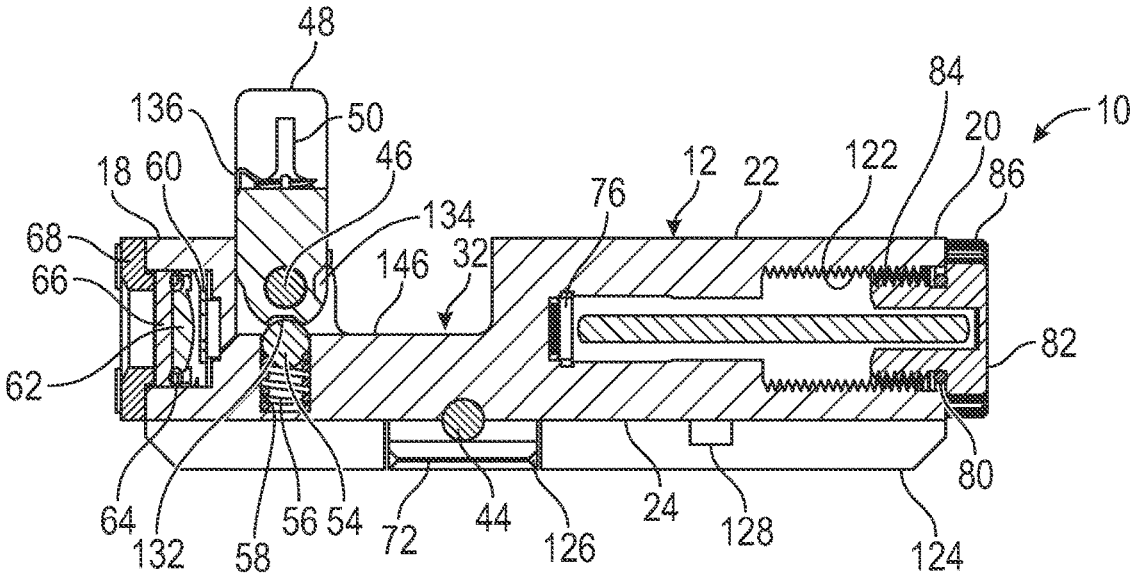
FIG. 4 is a side sectional view of the current embodiment of the firearm illuminator of FIG. 1 taken through the detent ball.
Figure 5:
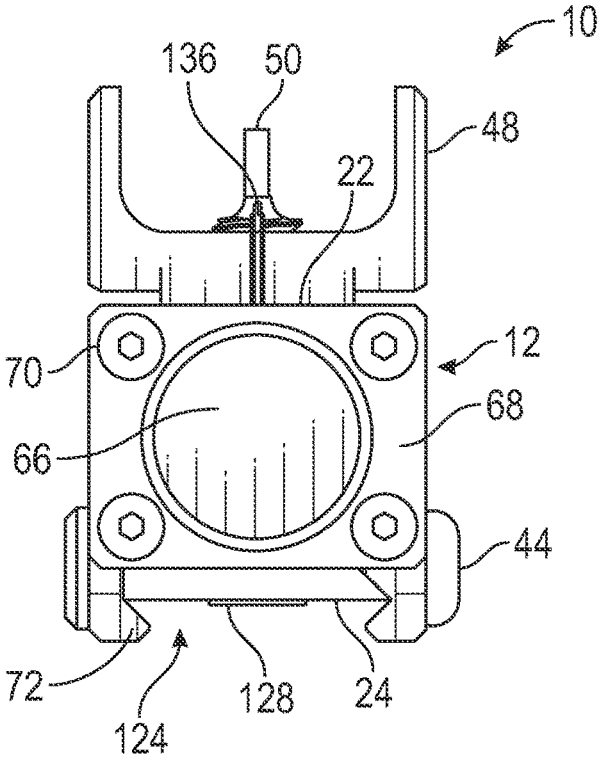
FIG. 5 is a front view of the current embodiment of the firearm illuminator of FIG. 1 with the iron sight in the raised position.
Figure 6A:
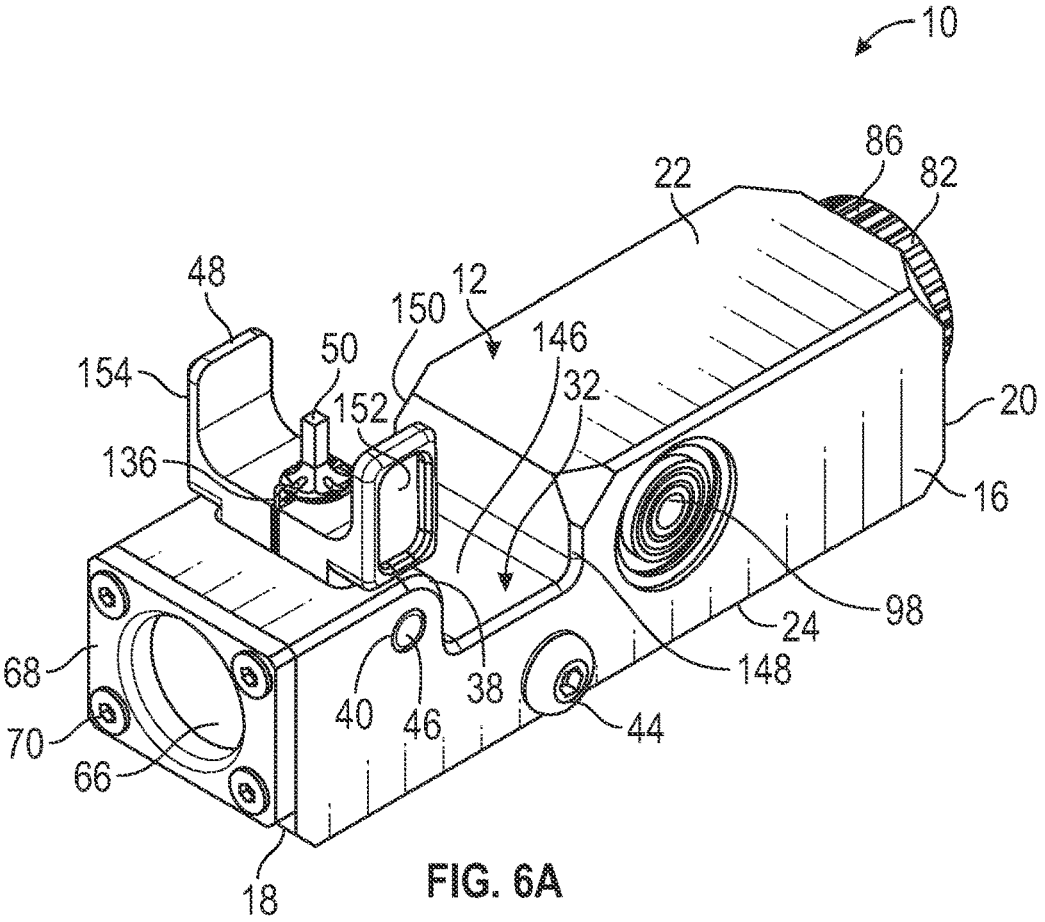
FIG. 6A is top front isometric view of the current embodiment of the firearm illuminator of FIG. 1 with the iron sight in the raised position.
Figure 6B:
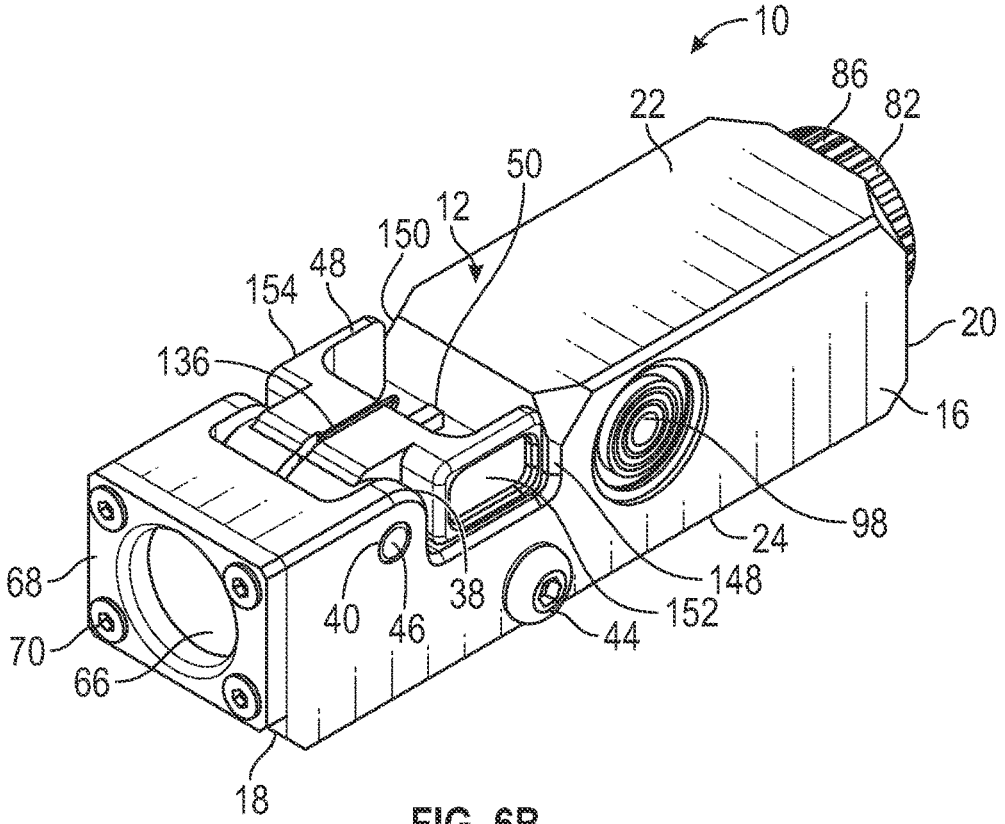
FIG. 6B is top front isometric view of the current embodiment of the firearm illuminator of FIG. 1 with the iron sight in the stowed position.
Figure 6C:
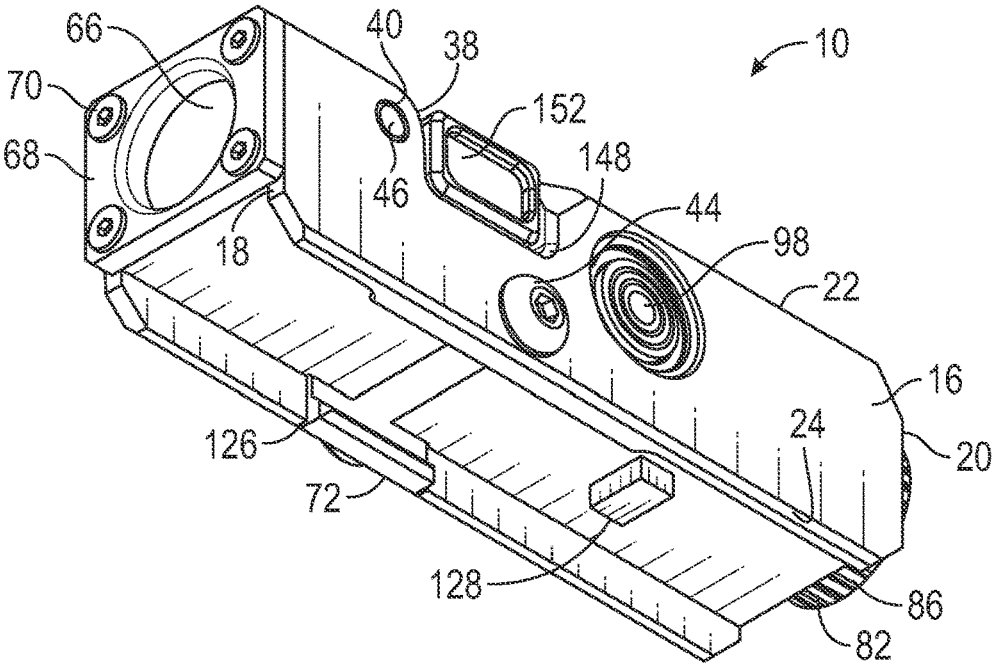
FIG. 6C is bottom front isometric view of the current embodiment of the firearm illuminator of FIG. 1 with the iron sight in the stowed position.

An embodiment of the firearm illuminator of the present invention is shown and generally designated by the reference numeral 10.

FIGS. 1-6C illustrate the improved firearm illuminator 10 of the present invention. More particularly, the firearm illuminator has a body/housing 12 having a right side 14, left side 16, front portion 18, rear portion 20, top 22, and bottom 24. In the current embodiment, the body is milled from a monolithic piece of aluminum. The body defines a central bore 26 extending from the front to the rear. The central bore has a front portion 116, intermediate portion 118, and rear portion 120 (visible in FIG. 3), with the intermediate portion located between the front and rear portions. The body also defines a transverse bore 28 that is in communication with the rear portion of the central bore. The front of the body defines four blind threaded holes 30. The top of the body defines a sight pocket 32 that is located between the front portion and rear portions of the central bore and above the intermediate portion of the central bore. The top of the body defines a right ear 34 defining an aperture 36 and a left ear 38 defining an aperture 40. A bore 42 extends from the right side to the left side of the body just above the bottom and below the intermediate portion of the central bore. A clamp screw 44 is received within the bore 42. A sight base pin 46 is received within the apertures 36, 40. A sight base 48 is pivotally connected by the sight base pin to the top of the body. The sight base defines a threaded bore 114 (visible in FIG. 3) that threadedly receives a sight post 50. The height of the sight post can be adjusted without tools by rotating the sight post within the threaded bore. The sight base pin also connects a sight post spring 52 to the body. The top of the body defines a bore 58 within the sight pocket that receives a sight base detent 54 that is biased upwardly by a sight base detent spring 56. The sight base has a bottom 130 that defines to detent notches 132, 134 (visible in FIG. 4) that are offset by 90°. The detent notch 132 receives the sight base detent to releasably secure the sight base in the raised/extended position (denoted by the dashed lines in FIG. 1 and shown in FIGS. 4, 5 and 6A), and the detent notch 134 receives the sight base detent to releasably secure the sight base in the stowed position (denoted by the solid lines in FIG. 1 and shown in FIGS. 3, 6B, and 6C).

The sight post spring 52, which includes a top hook 136, has two functions. First, a coil 138 of the sight post spring presses into a groove 140 on the sight base pin to retain the sight base pin within the body 12. Second, the top hook rests in one of multiple grooves 144 defined by the sight post to prevent the sight post from inadvertently rotating. The top hook is pulled out of the grooves 144 while the user adjusts the height of the sight post.

The sight post 48 is an indicating portion that extends above the body 12 when in the raised/extended position. The top 22 of the body is an upper surface below a selected limit level, and the sight base and sight post form a weapon sight that is configured to extend above the limit level. The top of the body can also be viewed as an upper surface portion associated with at least one of the front and rear portions 18, 20 of the body. The sight pocket 32 is a recess defined between the front and rear portions of the body having a floor 146 below the selected limit level and above the intermediate portion. The sight base and sight post are above the floor and below the limit level when received by the sight pocket in the stowed position. The body is open laterally above the floor to define lateral openings 148, 150. The sight base includes actuation surfaces 152, 154 on opposed lateral sides that are accessible via the lateral openings. The right and left sides 14, 16 of the body are opposed sidewalls, and the actuation surfaces are registered with the sidewalls.

The front portion 116 of the central bore 26 receives an LED 60, lens 62, front O-ring 64, and a window 66. These components form a light source and are removably secured within the front portion by a window retainer 68 that is removably secured to the front 18 of the body by four window retainer screw 70 threadedly received in blind threaded holes 30. The rear portion 120 of the central bore receives an LED driver 74, LED driver retainer 76, and battery 78. The battery is a power source that can be rechargeable or single use and can be a standard size. A rear O-ring 80 is received by tail cap 82, which has a threaded portion 84 that threadedly engages threads 122 (visible in FIG. 3) defined by the rear portion to releasably secure these components in the rear portion. The tail cap also includes a knurled portion 86 to enable the user to better grip and rotate the tail cap. The LED driver includes two forwardly extending conductors 88 that extend through the intermediate portion 118 of the central bore beneath the sight base 48 and sight post 50 to electrically connect the LED driver to the LED. The LED driver also includes a right switch interface 90 that is electrically connected to a right dome switch 104 and a left switch interface 92 that is electrically connected to a left dome switch 94. The left and right dome switches enable ambidextrous operation of the LED. It should be appreciated that no adhesives other than solder are used to assemble the firearm illuminator 10. Therefore, the firearm illuminator can be easily disassembled for repair or to upgrade the LED or LED driver as more advanced components become available. Furthermore, the lens and LED can be replaced with different designs to produce a desired light pattern (spot, flood, etc.). The sight base and sight post form a weapon sight that is connected above the intermediate portion of the central bore between the light source and the power source.

The left dome switch 94, left switch housing 96, left switch seal 98, and left switch washer 100 are secured within the left side 16 of the transverse bore 28 by left switch retaining ring 102. The right dome switch 104, right switch housing 106, right switch seal 108, and right switch washer 110 are secured within the right side 14 of the transverse bore by right switch retaining ring 112. The O rings 64, 80 and the left and right switch seals 98, 108 completely seal the central bore 26 and transverse bore 28 to prevent moisture from intruding.

The bottom 24 of the body 12 includes a rail mounting/attachment facility 124. The rail mounting facility is sized to closely receive a top accessory rail/firearm mounting element 202 on a rifle 200 as shown in FIG. 1 to removably connect the body to the top accessory rail. The rail mounting facility includes a downwardly facing boss 128 (visible in FIG. 6C) sized to be closely received within one of the transverse channels 204 defined by the top accessory rail. The boss prevents the body from drifting when the rifle recoils. The rail mounting facility also defines a clamp slot 126 (visible in FIG. 6C). A clamp 72 attached to the clamp screw 44 is received within the clamp slot. The clamp screw is tightened to pull the clamp tightly against the top accessory rail to releasably secure the firearm illuminator 10 to the rifle. As is shown in FIG. 1, the firearm illuminator can be installed on the same top accessory rail in conjunction with an optical sight 206 defining a sight axis 210. It should be appreciated that the sight picture through the optical sight is not obscured by the firearm illuminator when the sight base 48 is in the stowed position. The sight base and sight post 50 form a front sight that can be configured to register with a rear weapon sight, which could be the optical sight with the sight post being aligned with the sight axis, or a separate rear sight.

The firearm illuminator 10 is particularly attractive to commercial, military, law enforcement, and private security users. The illumination provided is used for positive identification of a target in low light conditions, and the integrated iron sight can be used as a primary or backup aiming device. The firearm illuminator is mounted at the forwardmost end of the top accessory rail 202 using the clamp screw 44 and clamp 72. The user's support hand is positioned on the handguard 208 such that the user can rest the thumb or forefinger of the user's support hand on one of the left or right switch seals 98, 108. When light is required, the user depresses one of the left or right switch seals to actuate the left or right dome switch 94, 104. In the current embodiment, the right and left dome switches act as a momentary switch. The circuitry and/or programming of the LED driver 74 determine the behavior of the LED 60 in response to dome switch actuation. A different LED driver could be capable of processing both momentary and toggle commands, as well as LED brightness. For example, hold down either dome switch for momentary light, double tap either dome switch for toggle, or press both dome switches at the same time to cycle LED brightness levels. When the LED driver completes an electrical circuit, electricity flows from the cathode of the battery 78 through the LED driver 74 to the LED via one of the conductors 88, back through the LED driver via the other one of the conductors 88, through the body 12, through the tail cap 82, and into the anode of the battery.

When the user needs to use the integrated iron sight, the user pivots the sight base 48 about the sight base pin 46 to dislodge the sight base detent 54 from notch 134 and engage the sight base detent with notch 132. The sight post spring 52 urges the sight base upwards from the stowed position to the raised position. To stow the integrated iron sight, the user overcomes the resistance provided by the sight post spring and pivots the sight base about the sight base pin to dislodge the sight base detent from notch 132 and engage the sight base detent with notch 134.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a firearm illuminator has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm illuminator comprising:

a housing having a front portion, a rear portion, and an intermediate portion between the front and rear positions;

a light source at the front portion;

a power source at the rear portion;

a power conductor interconnecting the light source and the power source and coextensive with the intermediate portion; and a weapon sight connected at the intermediate portion between the light source and the power source; and wherein the weapon sight is movable between a stowed position and an extended position.

2. The firearm illuminator of claim 1 wherein the weapon sight is a post sight.

3. The firearm illuminator of claim 1 wherein the weapon sight is a front sight configured to register with a rear weapon sight.

4. The firearm illuminator of claim 1 wherein an indicating portion of the weapon sight extends above the housing when in the extended position.

5. The firearm illuminator of claim 1 wherein the housing has an upper surface below a selected limit level, and wherein the weapon sight is configured to extend above the limit level.

6. The firearm illuminator of claim 5 wherein the intermediate portion has a floor below the selected limit level.

7. The firearm illuminator of claim 6 wherein the weapon sight is movable between a stowed position and an extended position, and is above the floor and below the limit level when in the stowed position.

8. The firearm illuminator of claim 6 wherein the housing is open laterally above the floor to define lateral openings.

9. The firearm illuminator of claim 8 wherein the sight includes actuation surfaces on opposed lateral sides and accessible via the lateral openings.

10. The firearm illuminator of claim 9 wherein the housing has opposed sidewalls and wherein the actuation surfaces are registered with the sidewalls.

11. The firearm illuminator of claim 1 wherein the housing includes an attachment facility configured to connected to a firearm mounting element.

12. A firearm illuminator comprising:

a housing having a front portion, a rear portion, and an intermediate portion between the front and rear positions;

a light source at the front portion;

a power source at the rear portion;

a power conductor interconnecting the light source and the power source and coextensive with the intermediate portion; and a weapon sight connected at the intermediate portion between the light source and the power source; and wherein the sight is pivotally connected to the housing.

13. The firearm illuminator of claim 1 wherein the power conductor extends beneath the weapon sight.

14. An illuminator and gunsight assembly for a firearm having a mounting facility and a rear sight defining a sight axis, the assembly comprising:

a housing;

a mounting facility on the housing configured to removably connect to the firearm mounting facility;

the housing having a front portion including a light source;

the housing having a rear portion including a power source;

a front sight between the front portion and rear portion;

the front sight movable between a stowed position and an extended position in which the front sight is aligned with the sight axis; and the housing having an upper surface portion associated with at least one of the front and rear portions, the front sight being below the upper surface portion when in the stowed position and extending above the upper surface portion when in the extended position.

15. The illuminator and gunsight assembly of claim 14 wherein the housing defines a recess between the front and rear portions and receiving the sight.

16. The illuminator and gunsight assembly of claim 15 wherein the recess is open laterally.

17. The illuminator and gunsight assembly of claim 14 wherein the sight is pivotally connected to the housing.

* * * * *